US006438754B1

(12) United States Patent
Canney

(10) Patent No.: US 6,438,754 B1
(45) Date of Patent: Aug. 27, 2002

(54) WEIGHT DISPLACING KNEE PROTECTOR PAD

(76) Inventor: Kevin Patrick Canney, 118 Norwood St., Mont Clare, PA (US) 19453

( * ) Notice: Subject to any disclaimer, the term of this patent is extended or adjusted under 35 U.S.C. 154(b) by 0 days.

(21) Appl. No.: 09/946,979

(22) Filed: Sep. 6, 2001

(51) Int. Cl.[7] ..... A41D 13/00
(52) U.S. Cl. ..... 2/22
(58) Field of Search ..... 2/22, 24, 16, 455, 2/911; 128/882; 602/23, 62

(56) References Cited

U.S. PATENT DOCUMENTS 696,764 A * 4/1902 Shibe ..... 2/22
2,338,424 A * 1/1944 Giardini ..... 2/22
5,405,312 A * 4/1995 Jacobs ..... 128/892
5,537,689 A * 7/1996 Dancyger ..... 2/24
5,784,715 A * 7/1998 Buchanan ..... 2/22
5,983,391 A * 11/1999 Palmer et al. ..... 2/16
6,158,051 A * 12/2000 Belzidsky ..... 2/16

* cited by examiner

*Primary Examiner*—Gloria M. Hale
*Assistant Examiner*—Tejash Patel

(57) ABSTRACT

A weight displacing knee protector pad having a main body comprised of a piece of foam or the like covered with a protective coating such as fabric. The foam has a top and a bottom and a front and a back and two sides. The top has a contoured channel running longitudinally through the center that conforms to the shape of the lower leg. The foam is enclosed in a cover of heavy duty fabric material. A substantially rigid material with a nonslip surface is fastened to the padding and the cover on the bottom. The rigid material extends past the front edge of the foam just past the knee. The foam provides support to the lower leg but stops before the knee. The rigid bottom means displaces the weight which would usually be applied to the knee, back to the lower leg while providing support and balance when leaning forward. Affixed to each side of weight displacing knee protector pad for attaching it to the lower leg are two strapping means comprised of elastic or the like.

3 Claims, 4 Drawing Sheets

WEIGHT DISPLACING KNEE PROTECTOR PAD

CROSS-REFERENCE TO RELATED APPLICATIONS

| CROSS-REFERENCE TO RELATED APPLICATIONS | | | |
|---|---|---|---|
| 5,537,689 | 7/23/96 | Dancyger | 2/24 |
| D406,406 | 03/02/99 | Hettwer | D/29/120.1 |

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

The field of the invention relates to the field of knee pads that are used to protect the knees when kneeling on a surface. The present invention is an improvement over the prior art insofar as the padding only comes in contact with the lower leg and not the knee area. This takes all of the weight bearing pressure off the knee and displaces it across the lower leg. When prior art pads are used, the full weight of the user is placed onto the knee.

BRIEF SUMMARY OF THE INVENTION

The present invention comprises a main body comprised of a piece of foam or the like with a top and bottom and a front and a back and two sides. The top of the foam has a channel conforming to the lower leg running longitudinally along the center. The foam is enclosed in a cover made of a material such as heavy duty cordura. A substantially rigid material with a nonslip surface is attached to the cover on the bottom side of the padding. The rigid material is flush with the back end of the padding and extends past the front end of the padding to approximately the front of the knees. This will offset the imbalance which occurs if leaning forward on the pads in a kneeling position. When worn by the user, the pads are attached to front of the lower leg but do not extend as high as the knee, leaving the knee suspended above the rigid bottom material when in a kneeling position. Affixed to each side of the weight displacing knee protector pad is the strapping means comprised of elastic or the like for attaching the weight displacing knee protector pad to the lower leg of the user. The strapping means comprises four straps, each strap having one end affixed to the weight displacing knee protector pad and the other end having hook or loop material thereon for connecting with the strip on the other side such that the strap may be fastened tightly around the lower leg by placing the hook material on the loop material. However, other suitable fastening means may be used.

DETAILED DESCRIPTION OF THE INVENTION

Figure 1:
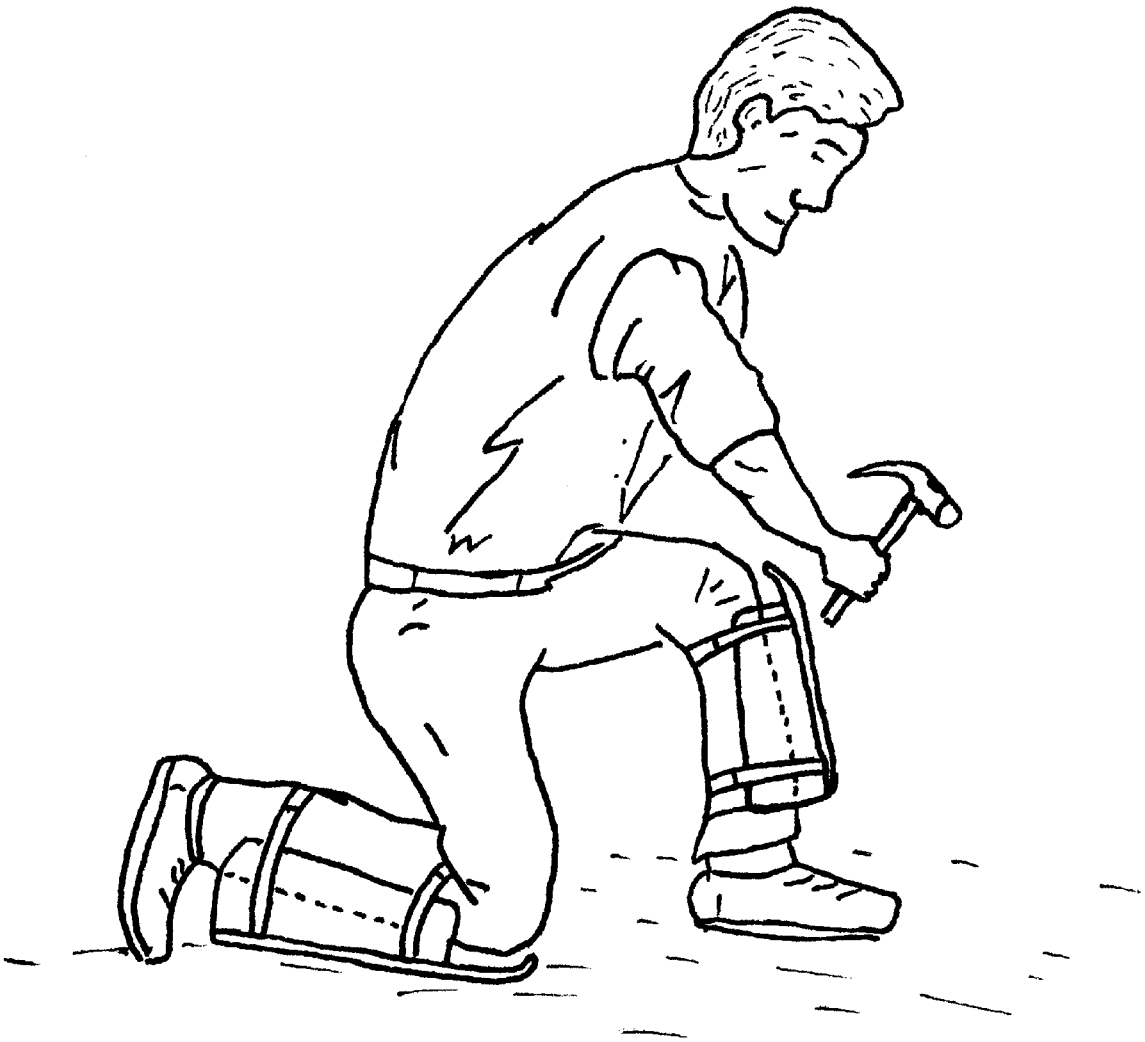
FIG. 1 is a perspective view of the weight displacing knee protector pad being utilized on a person.

Referring to the drawings, there is shown in FIGS. 1 through 6, a weight displacing knee protector pad 10. The weight displacing knee protector pad 10, comprises a main body 11, a rigid bottom means 12, and strapping means 13 and 14.

Figure 2:
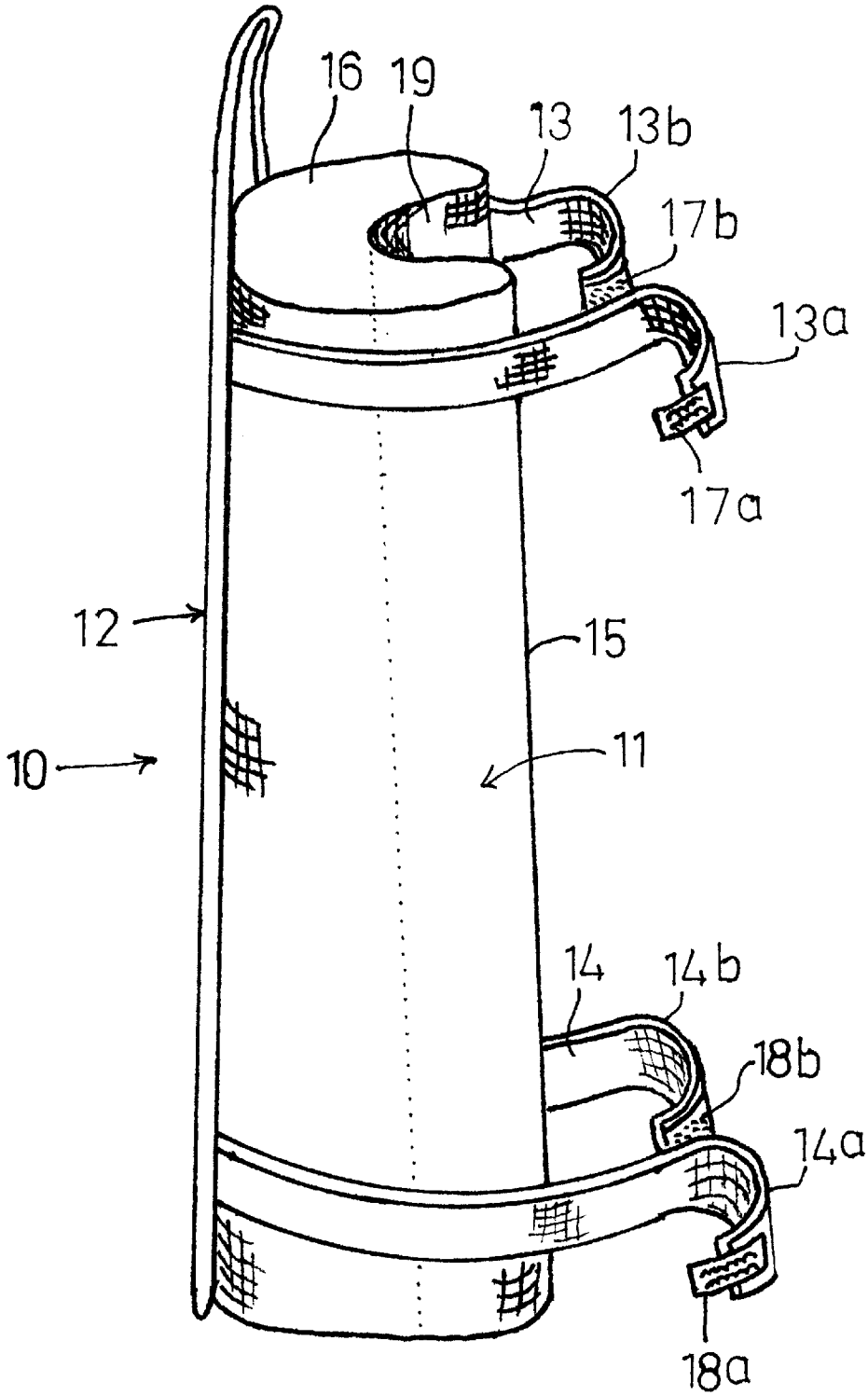
FIG. 2 is a right elevational view of the weight displacing knee protector pad.

Referring to FIG. 2, the weight displacing knee protector pad comprises a main body 11, with a covering of heavy duty fabric material 15, and an interior molded padding material 16. Strapping means 13 for strapping the weight displacing knee protector pad around the lower leg are affixed to each side of the main body 11 and to the rigid bottom means 12 proximate the front portion. Strapping means 14 for strapping the weight displacing knee protector pad around the lower leg are affixed to each side of the main body 11 and to the rigid bottom means 12 proximate the back portion. Strapping means 13 and 14 are comprised of a material such as elastic.

In the preferred embodiment, the strapping means 13 and 14 comprise 2 straps having 2 ends 13*a* and 13*b* and 14*a* and 14*b* respectively. Each end on each strap having fastening means thereon 17*a* and 17*b* and 18*a* and 18*b* respectively that may be fixedly engaged with each other. In the preferred embodiment, fastening means 17*a* and 18*a* have the loop material on the outside thereof and fastening means 17*b* and 18*b* have the hook material on the inside thereof, such that the straps may be fastened around the lower leg proximate the bottom of the knee and above the ankle by placing the hook material on the loop material. However, any other suitable fastening means may be used that will hold the weight displacing knee protector around the lower leg comfortably and which will prevent it from slipping. Strapping means 13 and 14 are sized so as to accommodate legs of varying sizes and weights.

Figure 3:
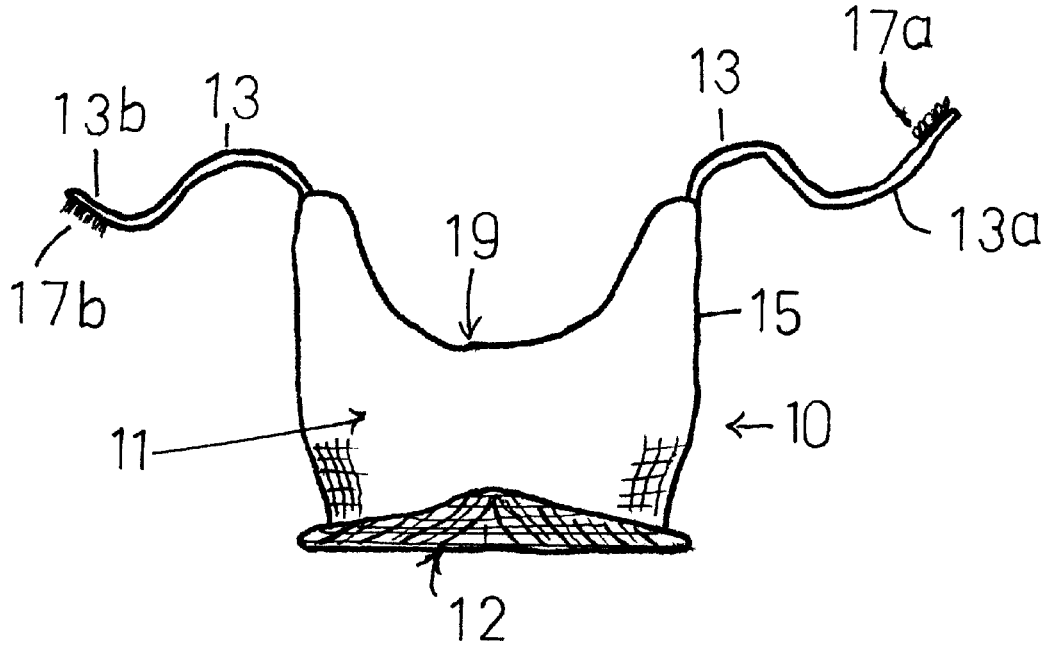
FIG. 3 is a front elevational view of a weight displacing knee protector pad.
Figure 4:
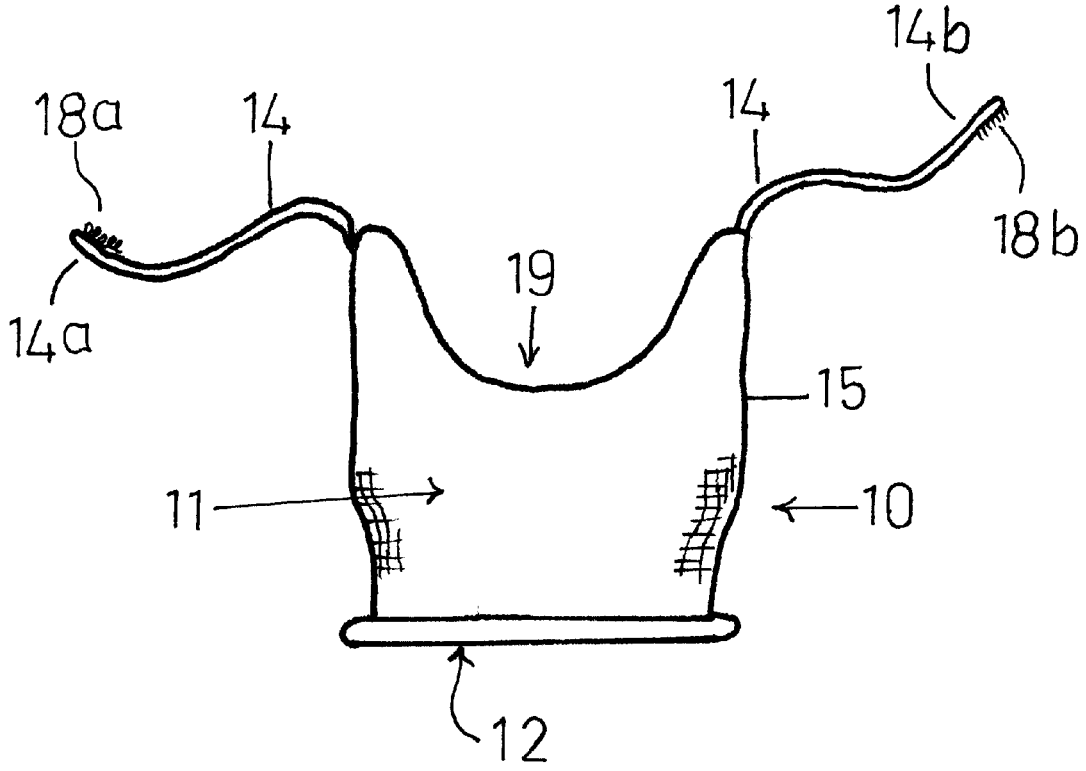
FIG. 4 is a rear elevational view of a weight displacing knee protector pad.
Figure 5:
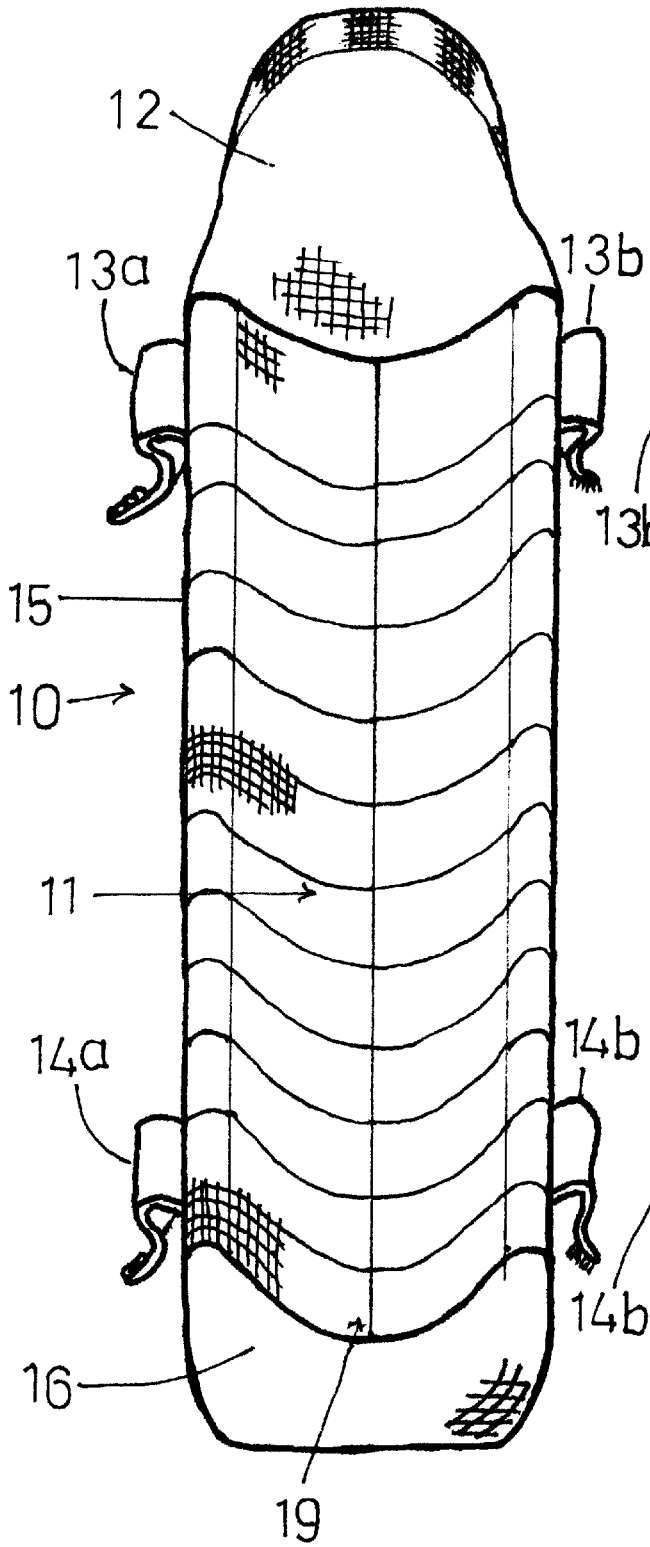
FIG. 5 is a top view thereof.

Referring to FIGS. 3, 4, and 5 in the preferred embodiment, the main body 11 has a contoured channel 19 running longitudinally across the top which conforms to the lower leg. The main body 11 provides support of the user which prevents the knee from touching any surface.

Figure 6:
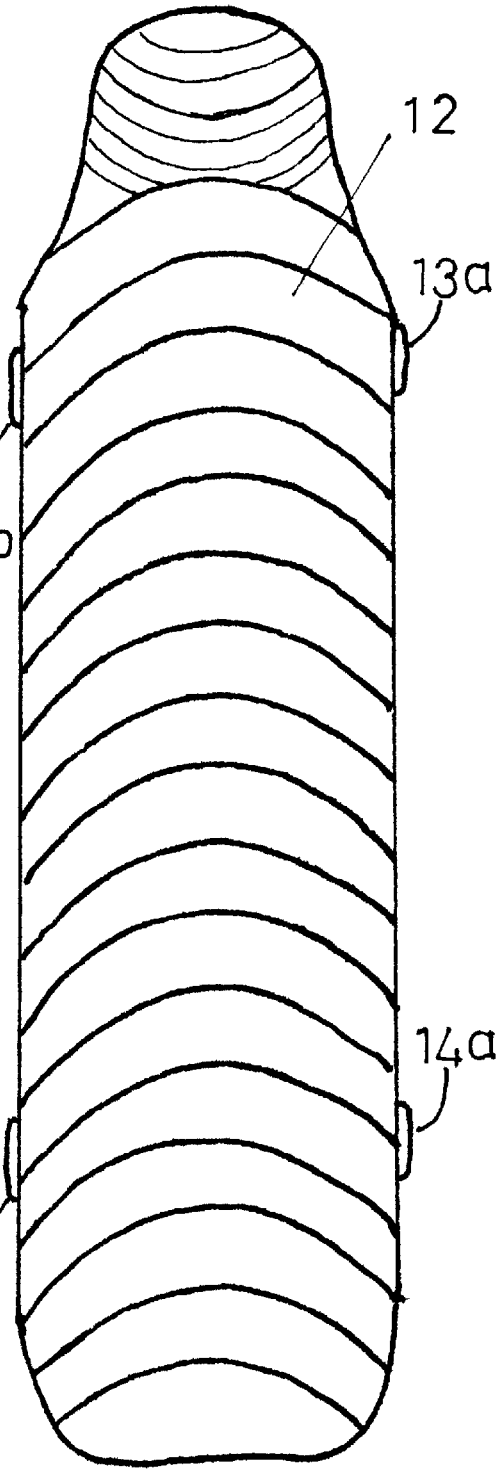
FIG. 6 is a bottom view thereof.

Referring to FIGS. 2, 5, and 6, the rigid bottom means 12 is attached to the bottom of the main body 11 and extends past the front edge of the main body 11 to approximately the front of the knee. The rigid bottom means 12 is fairly flat to provide stability to the wearer when in a kneeling position and arches slightly upwards towards the front for ease of moving and has a nonslip surface.

While particular embodiments of the invention have been shown and illustrated herein, it will be understood that many changes, substitutions and modifications may be made by those persons skilled in the art. It will be appreciated from the above description of the presently preferred embodiments that other configurations are possible and within the scope of the present invention, thus the present invention is not intended to be limited to the particular embodiments specifically discussed herein above.

I claim:

1. A weight displacing knee protector pad for suspending the knee above a contact surface comprising:

a soft molded padding material positioned on the shin of the user that extends from the ankle to just below the knee;

the molded padding material is defined by a main body having bottom, front, back, and side portions;

the knee protector supports the users weight by suspending the knee above the contact surface;

a contoured channel is formed between the front and back portions which runs along a center longitudinal axis of the padding and extends between the top and bottom portions;

the back portion of the contoured channel conforms to the shin of the user;

the sides of the main body include means for fastening the padding material about the shin;

a rigid flat material that has substantially similar surface area as the front portion is bonded thereto;

the rigid flat material extends from the bottom portion to an area above the top portion, which covers the knee at a distance therefrom;

the flat rigid flat material will protect the knee suspended above the surface when the protector is worn.

2. The invention as claimed in claim 1, wherein the means for fastening is a plurality of spaced apart straps located along one of the sides, which detachably corresponds to spaced apart straps positioned on opposite side thereof.

3. The invention as claimed in claim 1, wherein the rigid flat material has enough strength and rigidity to allow flexing without bending at the area above the top portion, by prevention the knee from coming in contact with the flat material.

* * * * *